US008210073B2

(12) United States Patent
Hu

(10) Patent No.: US 8,210,073 B2
(45) Date of Patent: Jul. 3, 2012

(54) RATCHET WRENCH

(76) Inventor: Bobby Hu, Taichung (TW)

( * ) Notice: Subject to any disclaimer, the term of this patent is extended or adjusted under 35 U.S.C. 154(b) by 253 days.

(21) Appl. No.: 12/778,263

(22) Filed: May 12, 2010

(65) Prior Publication Data

US 2011/0048178 A1 Mar. 3, 2011

(30) Foreign Application Priority Data

Aug. 31, 2009 (TW) ..... 98129319 A

(51) Int. Cl.
*B25B 13/46* (2006.01)

(52) U.S. Cl. ..... 81/63.1

(58) Field of Classification Search ..... 81/61–63.2
See application file for complete search history.

(56) References Cited

U.S. PATENT DOCUMENTS 6,431,031 B1 * 8/2002 Hu ..... 81/63.2
6,457,387 B1 * 10/2002 Hu ..... 81/63.2
6,568,299 B2 * 5/2003 Hu ..... 81/63.2
6,955,104 B2 * 10/2005 Hu ..... 81/63.2
7,278,339 B2 * 10/2007 Hu ..... 81/63.2
7,313,987 B1 * 1/2008 Chen ..... 81/63.1
7,328,633 B2 * 2/2008 Lin ..... 81/63.1
7,802,498 B2 * 9/2010 Hu ..... 81/63.1
7,827,886 B2 * 11/2010 Hu ..... 81/63.1
7,836,798 B2 * 11/2010 Hu ..... 81/63.1
7,895,921 B2 * 3/2011 Huang ..... 81/63.1
7,921,751 B2 * 4/2011 Hu ..... 81/63.1

* cited by examiner

*Primary Examiner* — Debra S Meislin
(74) *Attorney, Agent, or Firm* — Alan Kamrath; Kamrath IP Lawfirm, PA

(57) ABSTRACT

A ratchet wrench includes a head having a compartment rotatably receiving a drive member. A pawl groove is formed in an inner periphery of compartment and slideably receives two pawls. A slot is formed in a side of the head and in communication with the pawl groove. A first end of a control plate is pivotably mounted to an engaging portion of the drive member extending beyond the side of the head via a hole in the side. A second end of the control plate includes two legs extending through the slot into the pawl groove for actuating the pawls upon rotation of the control plate to change a driving direction of the ratchet wrench. A positioning device is provided to position the control plate.

10 Claims, 13 Drawing Sheets

RATCHET WRENCH

BACKGROUND OF THE INVENTION

The present invention relates to a ratchet wrench and, more particularly, to a ratchet wrench providing sensitive, accurate driving direction-switching operation and reliable positioning effect while prolonging the service life of the ratchet wrench.

U.S. Pat. No. 7,278,339 discloses a reversible ratchet wrench including a head rotatably receiving a drive member. A pawl is slideably received in the head between two positions and releasably engages with the drive member. A ring is mounted around an end of the drive member and includes a tip piece having a slot. A reversing plate is pivotably mounted to the end of the drive member and operatively connected to the ring to turn therewith. A switching member is pivotably received in a receiving hole of the head and includes a protrusion engaged in the slot of the tip piece of the ring such that the switching member is pivoted when the ring is pivoted. The switching member includes a receptacle receiving an elastic element and a pressing member biased by the elastic element to press against the pawl. The reversing plate is pivotable between two operative positions to move the pawl between the two positions to switch the driving direction of the ratchet wrench. However, friction between the ring and the reversing plate causes wear and generates scraps between the ring and the reversing plate. Furthermore, a positioning structure including a pin and a pin hole is required for positioning the reversing plate, leading to an increase in the manufacturing costs as well as adverse affect in the positioning effect due to accumulation of dust in the gaps between the positioning elements. Further, there are many elements between the reversing plate and the switching member with each element having its own play, leading to insensitive driving direction-switching operation. Further, a user may work with his or her head facing upward in some cases. Direction-switching operation may be a problem in these cases when a socket or an extension is coupled to a drive column of the drive member that faces upward, because gravitational force is imparted to the drive member from the socket, the extension or even the object to be the rotated by the ratchet wrench. The user has to remove the socket or extension from the drive column, flips the drive member so that the drive column faces downward, switches the driving direction, and reattaches the socket or extension to the drive column, which is extremely inconvenient and inefficient.

Thus, a need exists for a ratchet wrench providing sensitive, accurate driving direction-switching operation and reliable positioning effect as well as prolonging the service life of the ratchet wrench.

BRIEF SUMMARY OF THE INVENTION

The present invention solves this need and other problems in the field of sensitive, accurate operation of reversing plates of ratchet wrenches by providing, in a preferred form, a ratchet wrench including a head and a handle interconnected to the head. The head includes first and second sides. A compartment extends from the second side towards but spaced from the first side. The first side includes a hole in communication with the compartment. A pawl groove is defined in an inner periphery of the compartment. The first side of the head further includes a slot spaced from the hole in a length direction and in communication with the pawl groove. A drive member is rotatably received in the compartment about a rotating axis perpendicular to the length direction. The drive member includes a coupling section. An engaging portion extends from an end of the coupling section and has a portion extending beyond the head via the hole. A drive column extends from the other end of the coupling section beyond the second side of the head. First and second pawls are slideably received in the pawl groove. Each of the first and second pawls includes a toothed face releasably engaged with the coupling section of the drive member. An elastic element is mounted between the first and second pawls to bias the first and second pawls away from each other to engage the toothed faces of the first and second pawls with the coupling section of the drive member. A control plate includes first and second ends and inner and outer faces extending between the first and second ends of the control plate. The first end of the control plate is pivotably mounted to the portion of the engaging portion beyond the head between first and second operative positions about the rotating axis. The second end of the control plate includes first and second legs extending from the inner face of the reversing plate through the slot of the head into the pawl groove. A positioning device is mounted between the head and the control plate for positioning the control plate in one of the first and second operative positions.

When the control plate is in the first operative position, the toothed face of the second pawl is engaged with the coupling section of the drive member, the first leg is engaged with a first coupling portion of the first pawl to disengage the toothed face of the first pawl from the coupling section of the drive member, allowing the handle and the drive member to rotate in a first direction driving an object in the first direction, and allowing the handle to rotate freely relative to the drive member in a second direction reverse to the first direction without driving the object.

When the reversing plate is in the second operative position, the toothed face of the first pawl is engaged with the coupling section of the drive member, the second leg is engaged with a second coupling portion of the second pawl to disengage the toothed face of the second pawl from the coupling section of the drive member, allowing the handle and the drive member to rotate in the second direction driving the object in the second direction, and allowing the handle to rotate freely relative to the drive member in the first direction without driving the object.

Preferably, the first side of the head includes a receptacle, and the inner face of the control plate includes first and second positioning holes. The positioning device includes a positioning member and an elastic element received in the receptacle. The elastic element biases the positioning member into one of the first and second positioning holes to retain the control plate in one of the first and second operative positions.

In a preferred form, the slot is intermediate the hole of the head and the receptacle in the length direction, and the first and second positioning holes are formed in the second end of the control plate. In another preferred form, the hole of the head is intermediate the slot and the receptacle in the length direction, and the first and second positioning holes are formed in the first end of the control plate.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
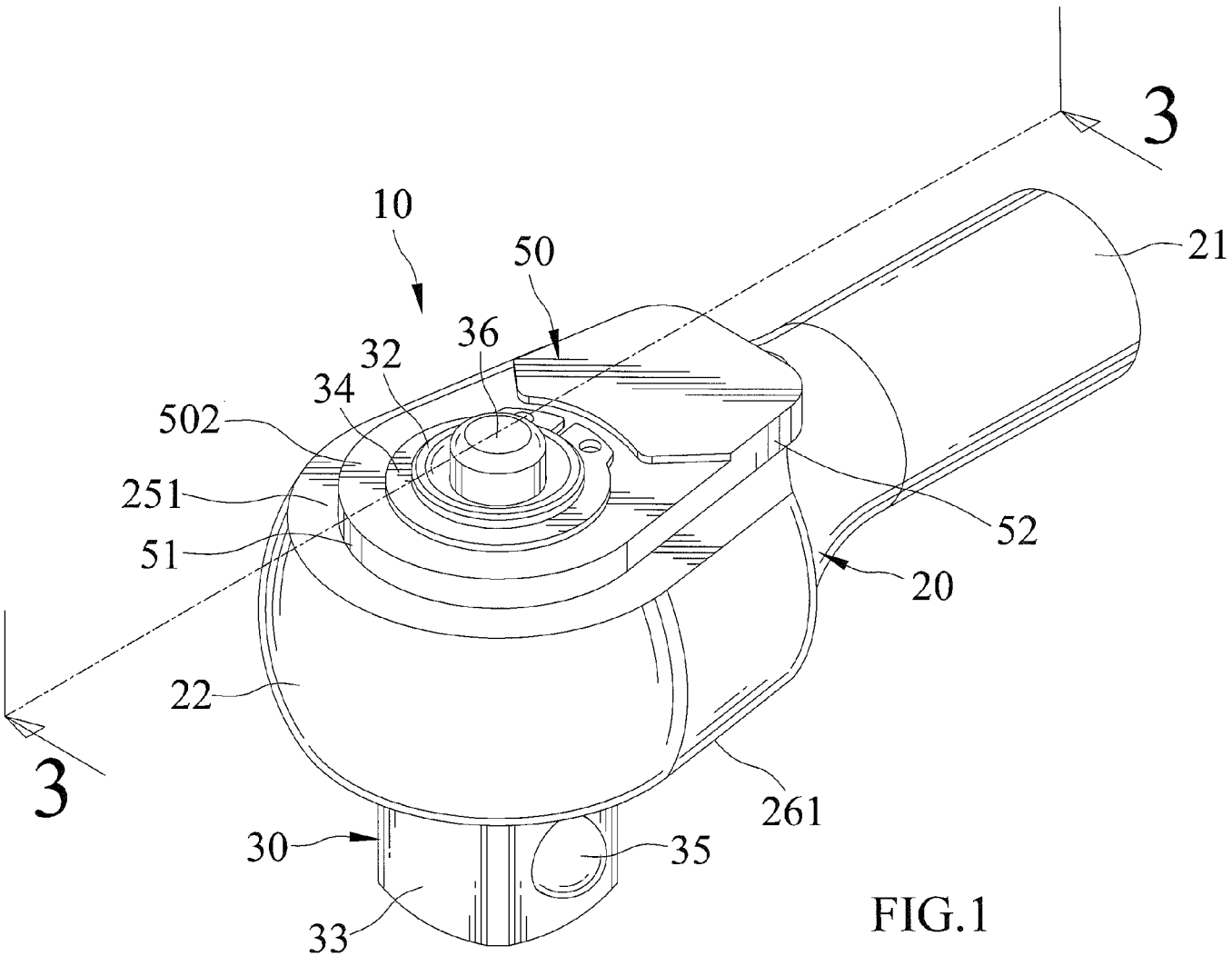
FIG. 1 shows a partial, perspective view of a ratchet wrench of an embodiment according to the preferred teachings of the present invention.
Figure 2:
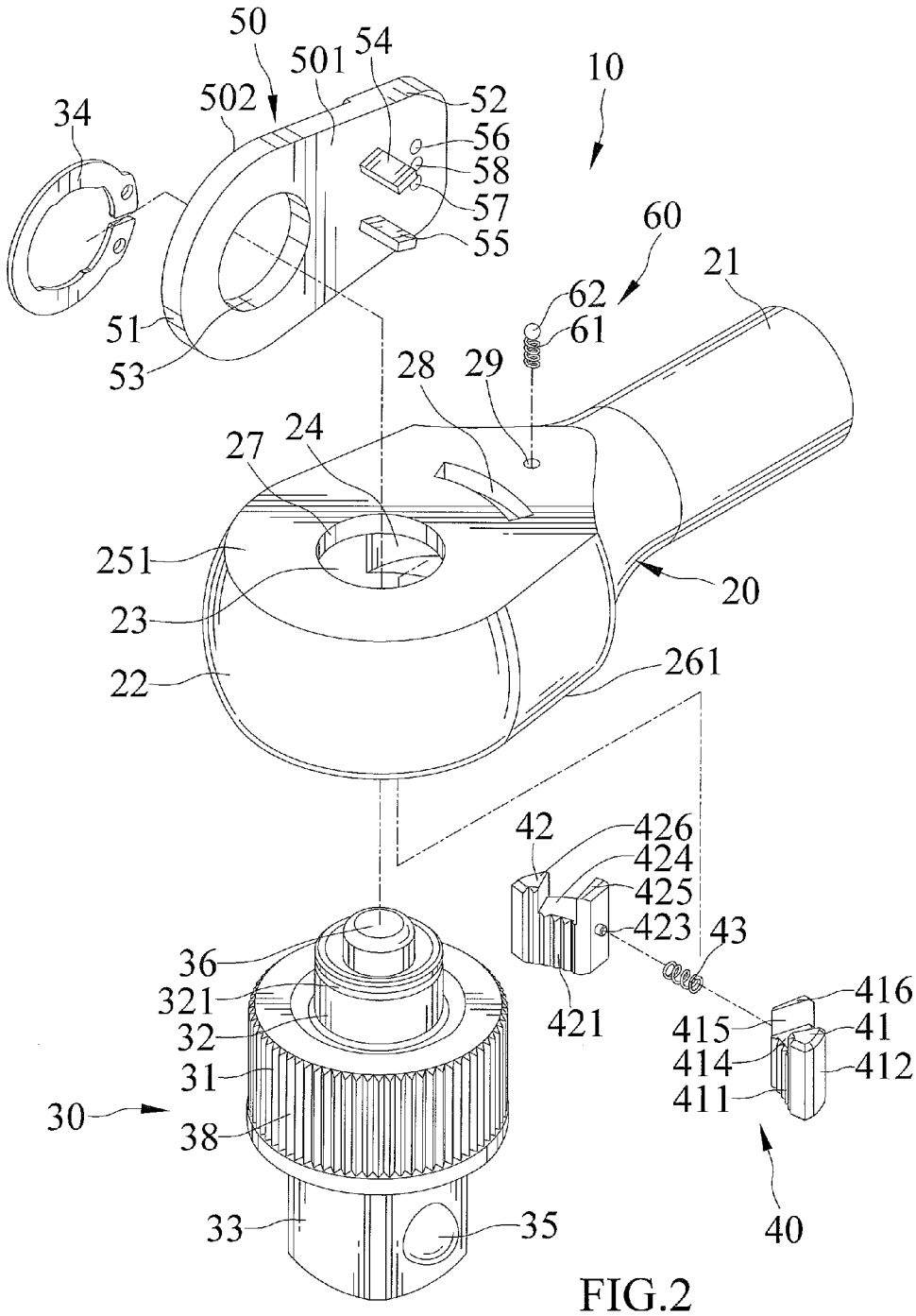
FIG. 2 shows a partial, exploded, perspective view of the ratchet wrench of FIG. 1.
Figure 3:
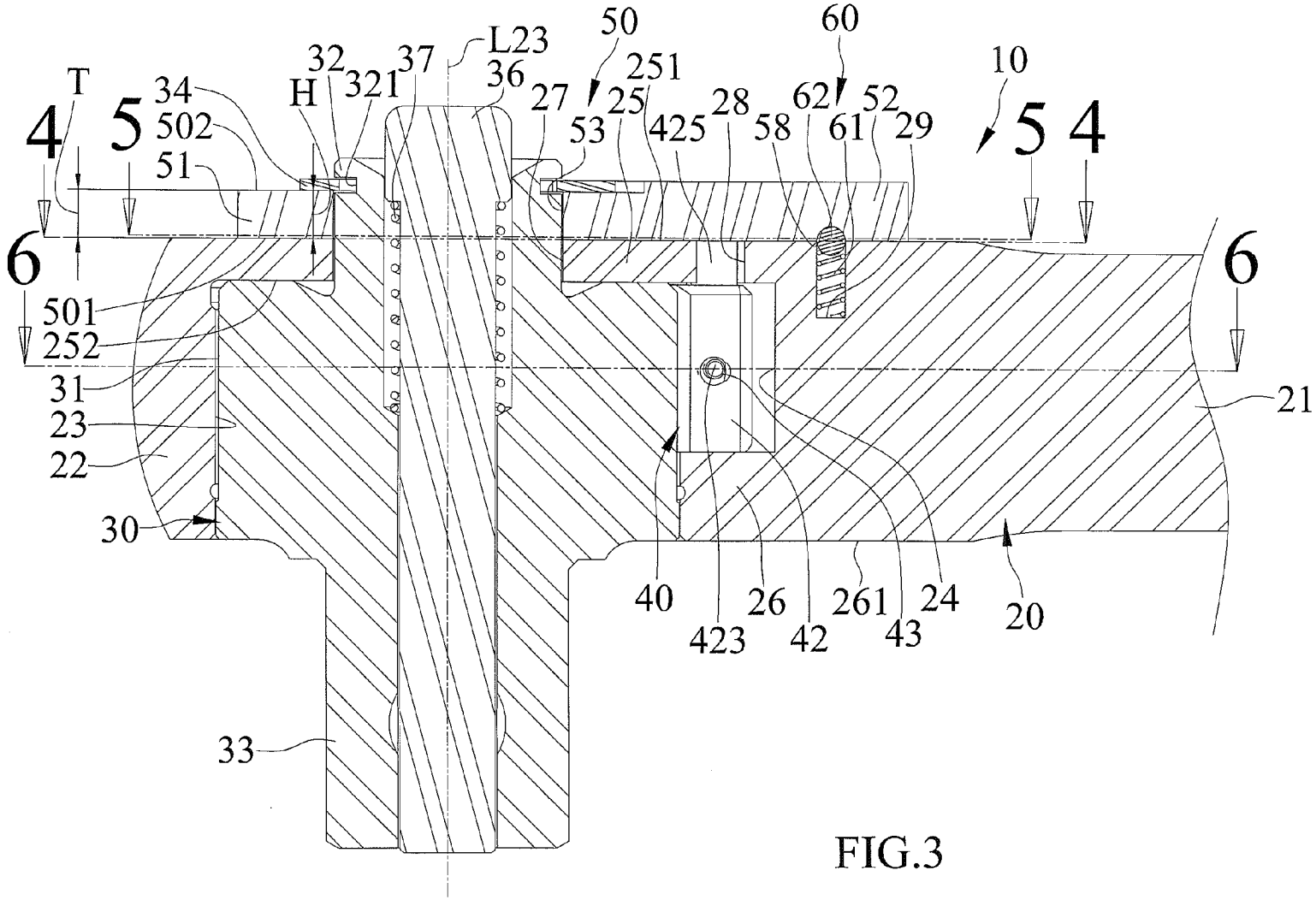
FIG. 3 shows a partial, cross sectional view of the ratchet wrench of FIG. 1 according to section line 3-3 of FIG. 1.
Figure 4:
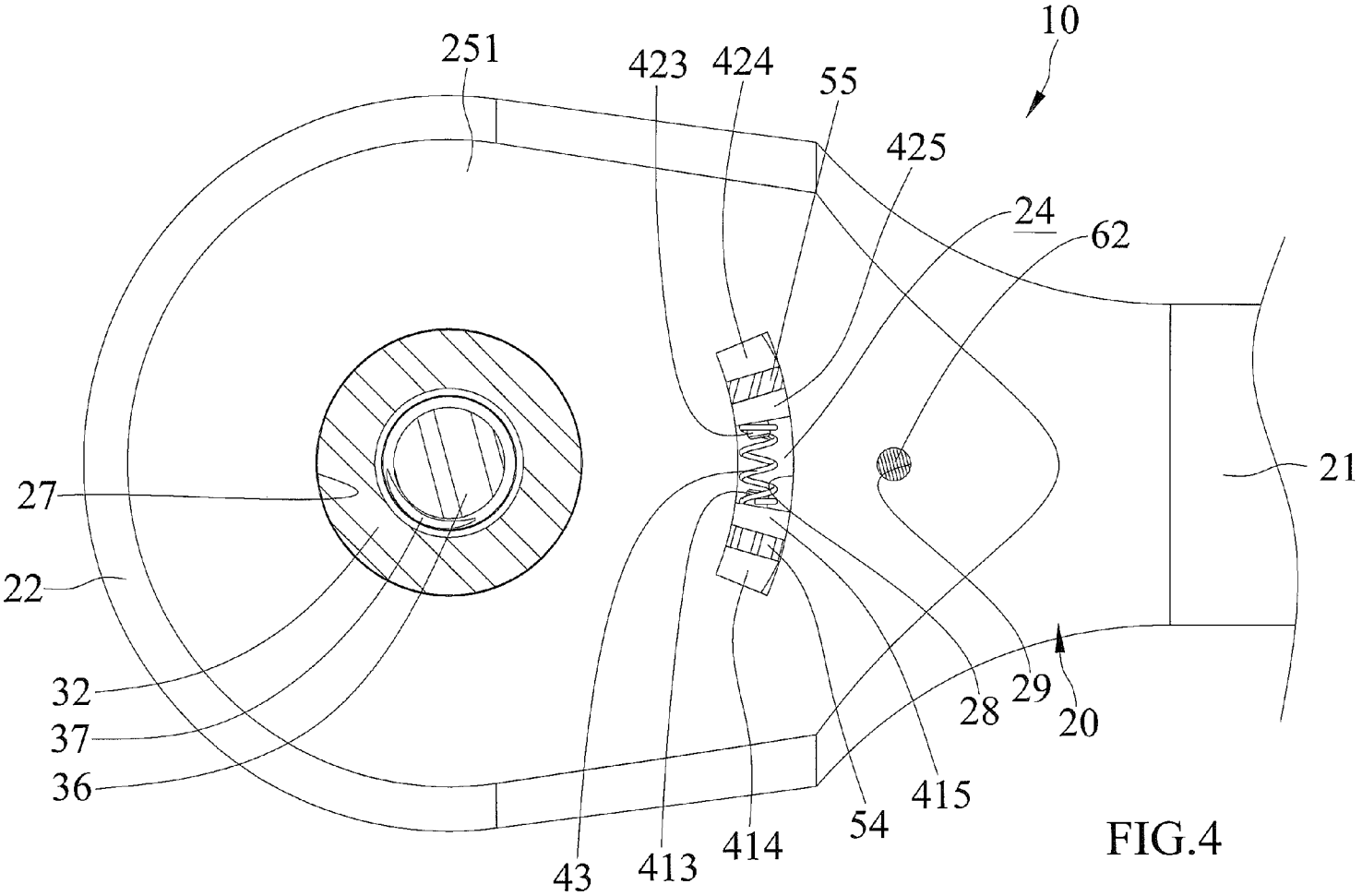
FIG. 4 shows a partial, cross sectional view of the ratchet wrench of FIG. 1 according to section line 4-4 of FIG. 3.
Figure 5:
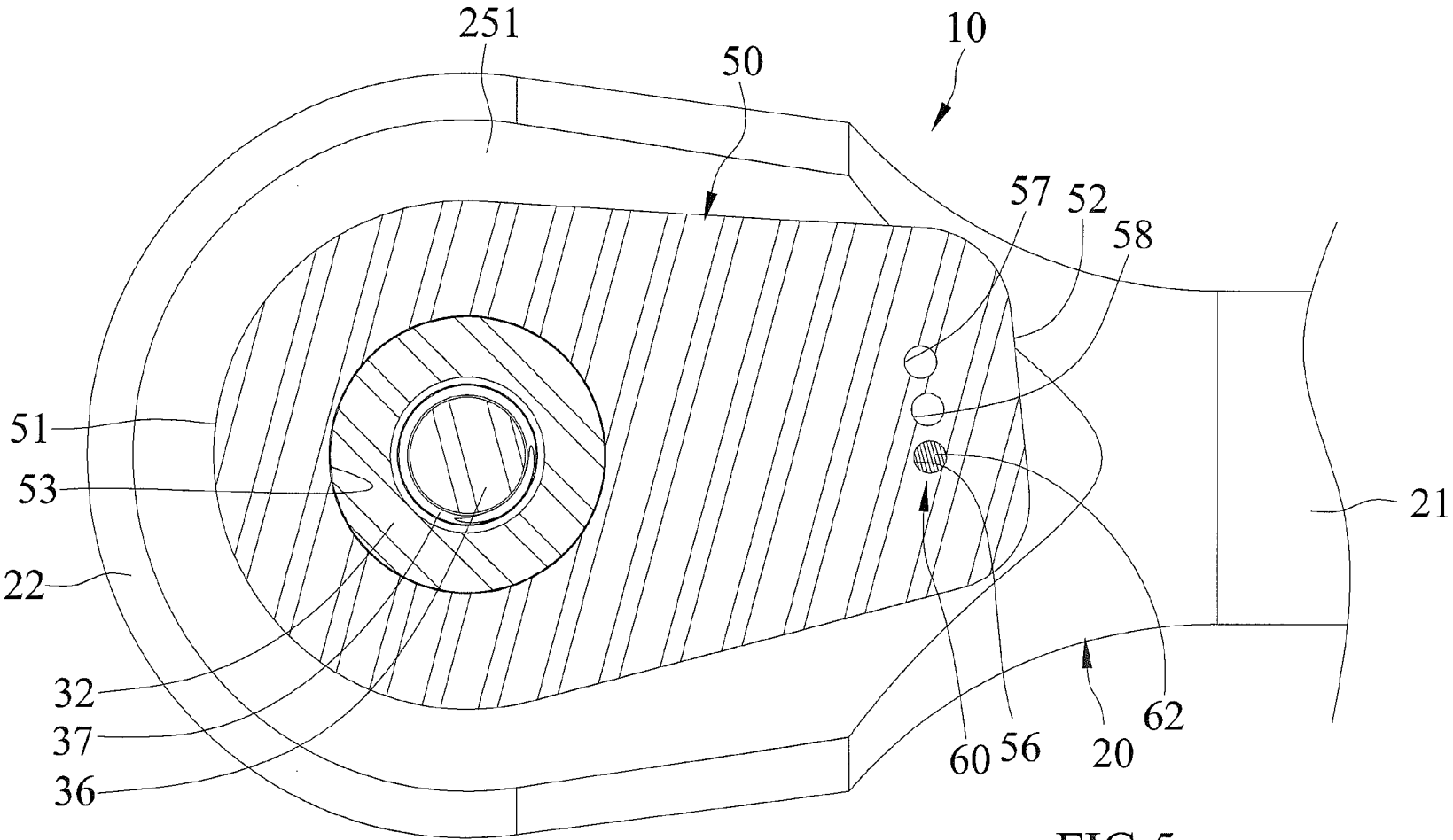
FIG. 5 shows a partial, cross sectional view of the ratchet wrench of FIG. 1 according to section line 5-5 of FIG. 3 with a control plate in a first operative position.
Figure 6:
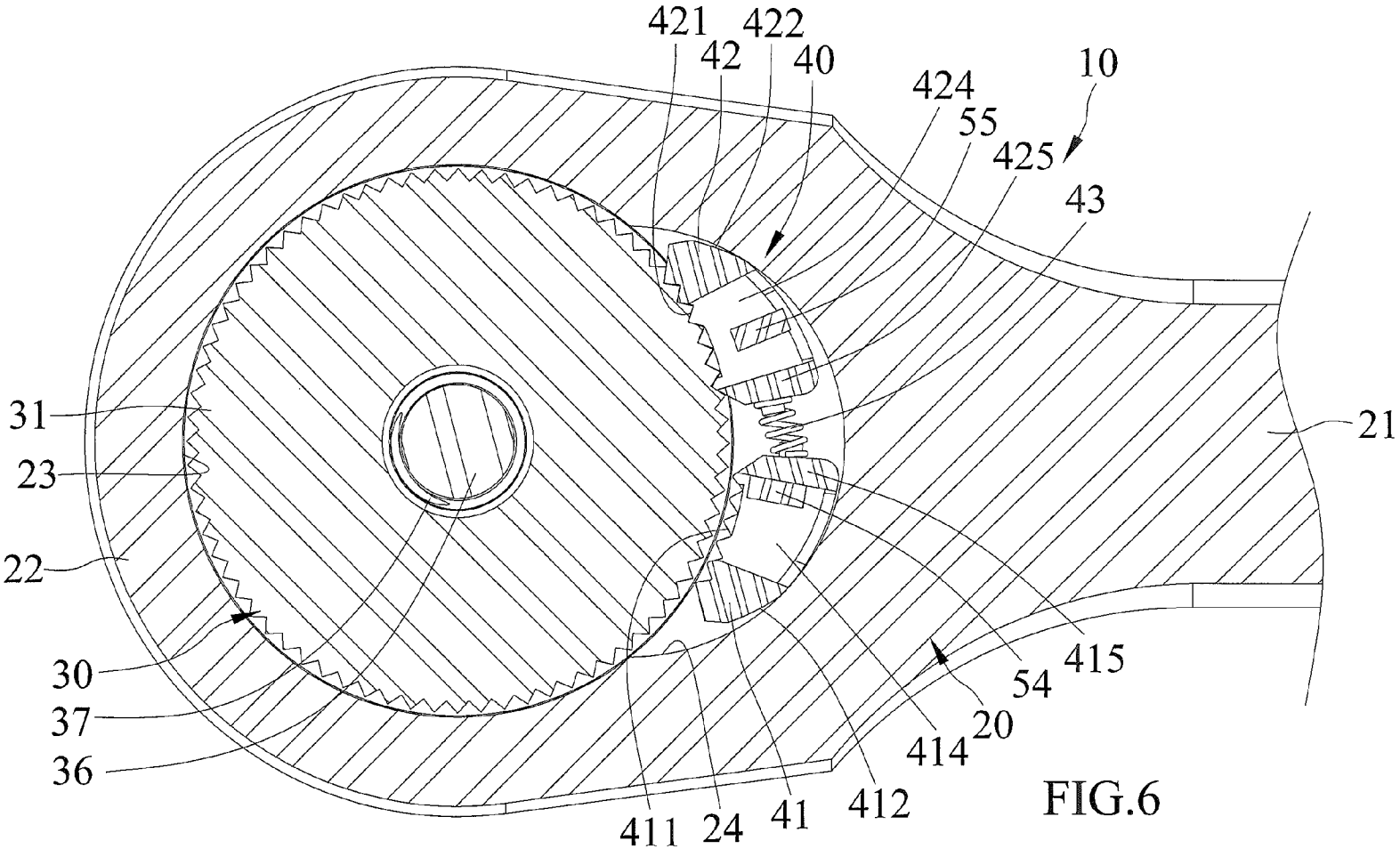
FIG. 6 shows a partial, cross sectional view of the ratchet wrench of FIG. 1 according to section line 6-6 of FIG. 3 with the control plate in the first operative position.
Figure 7:
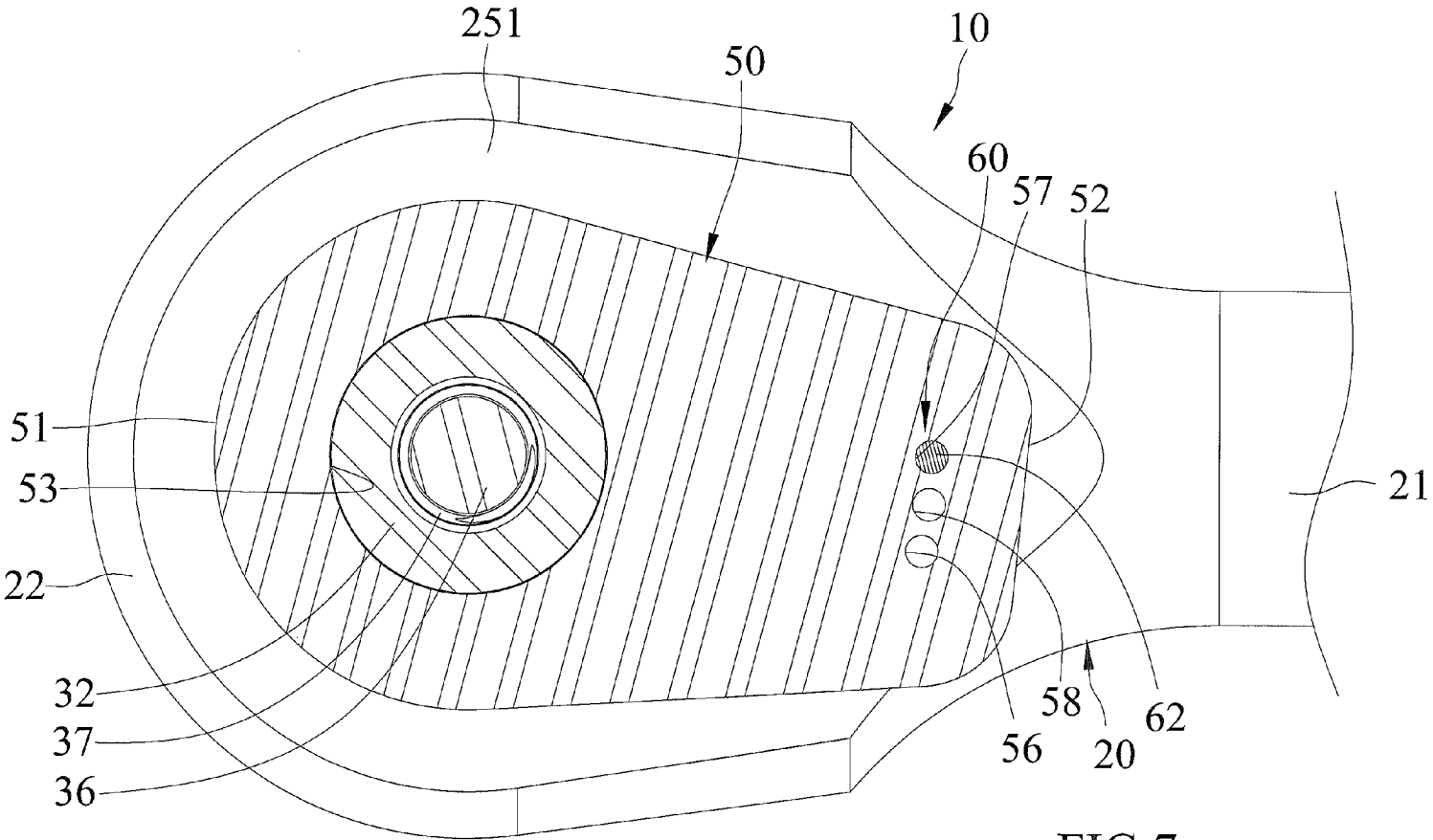
FIG. 7 shows a partial, cross sectional view similar to FIG. 5 with the control plate in a second operative position.
Figure 8:
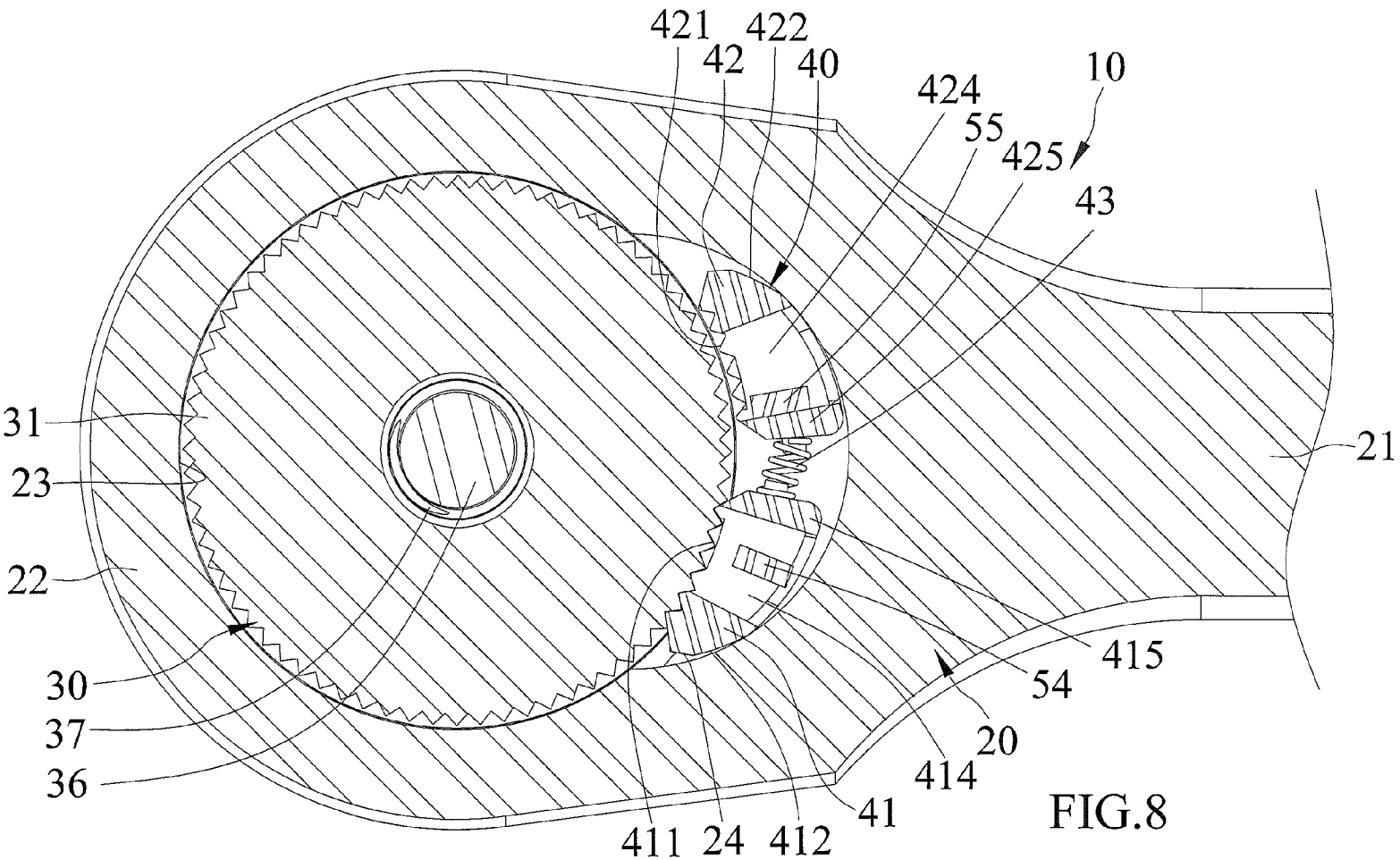
FIG. 8 shows a partial, cross sectional view similar to FIG. 6 with the control plate in the second operative position.
Figure 9:
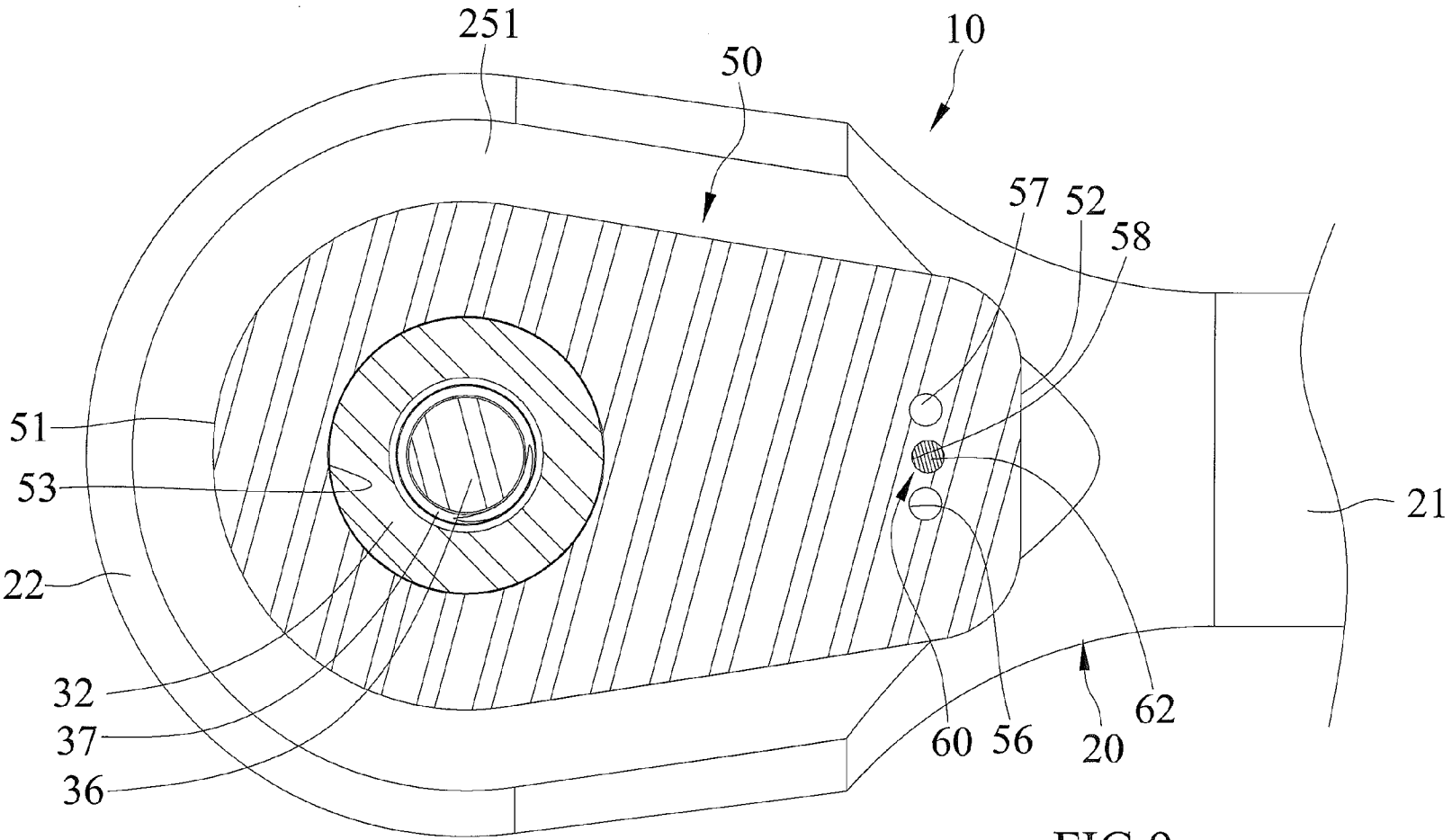
FIG. 9 shows a partial, cross sectional view similar to FIG. 5 with the control plate in a third operative position.
Figure 10:
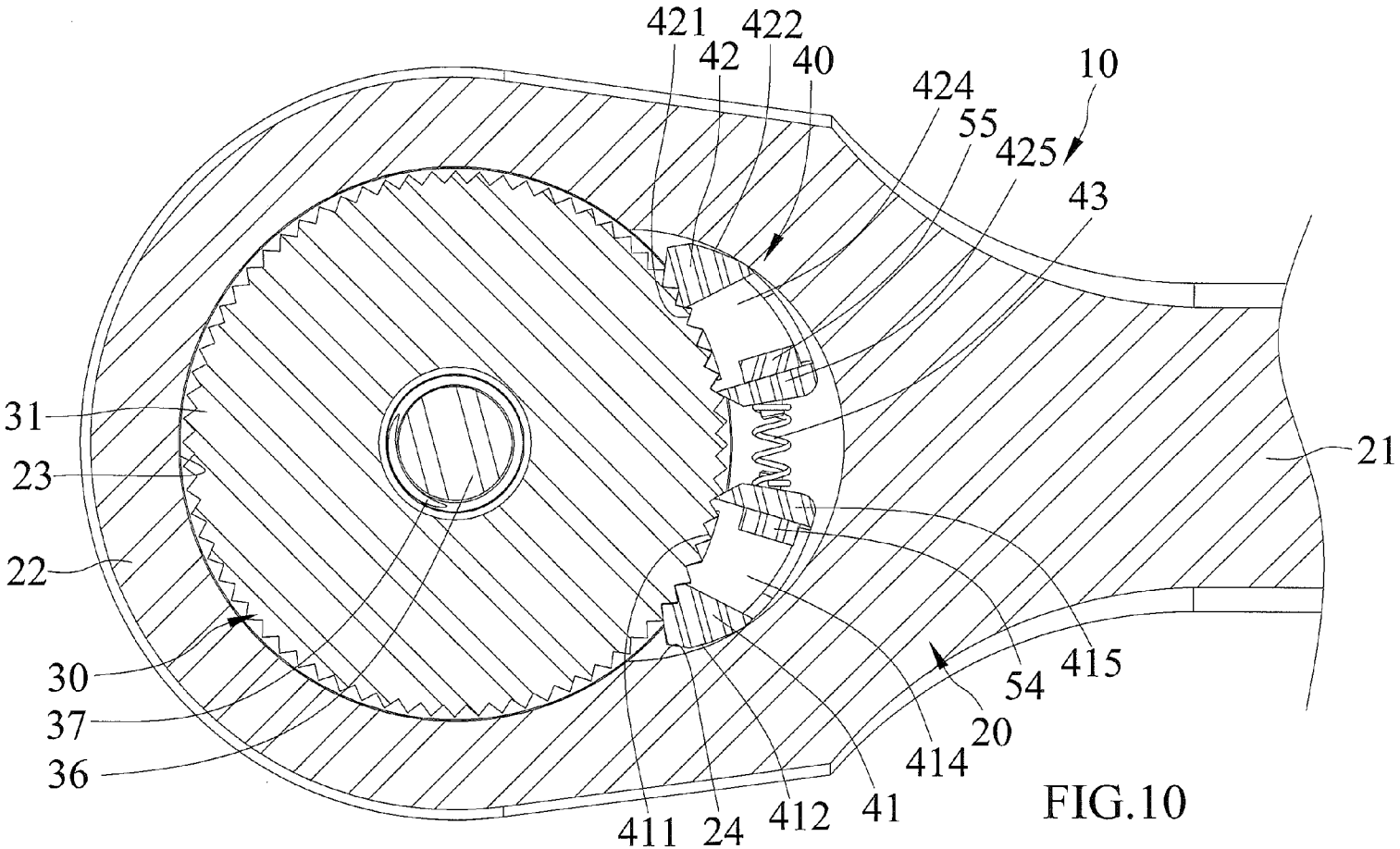
FIG. 10 shows a partial, cross sectional view similar to FIG. 6 with the control plate in the third operative position.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "inner", "outer", "side", "end", "portion", "section", "longitudinal", "clockwise", "counterclockwise", "spacing", "length", "thickness", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A ratchet wrench according to the preferred teachings of the present invention is shown in the drawings and generally designated 10. In preferred forms shown in FIGS. 1-13, ratchet wrench 10 includes a body 20 having a head 22 and a handle 21 interconnected to head 22. Head 22 includes first and second sides 25 and 26. A compartment 23 extends from second side 26 towards but spaced from first side 25. Compartment 23 is circular in cross section and defines a longitudinal axis L23. A pawl groove 24 is formed in an inner periphery of compartment 23 and is crescent in cross section. First side 25 includes parallel, spaced inner and outer surfaces 252 and 251. Compartment 23 is delimited by inner surface 252. First side 25 further includes a hole 27 in communication with and coaxial to compartment 23. Hole 27 has a diameter smaller than compartment 23. First side 25 further includes a slot 28 in communication with pawl groove 24. Slot 28 is spaced from hole 27 in a length direction perpendicular to longitudinal axis L23. Furthermore, slot 28 is arcuate and has a constant radius to longitudinal axis L23. Second side 26 has an outer surface 261 parallel to and spaced from outer surface 251 of first side 25.

In the preferred forms shown in FIGS. 1-13, a drive member 30 is rotatably received in compartment 23 about a rotating axis coincident to longitudinal axis L23 of compartment 23 and a longitudinal axis of hole 27. Drive member 30 includes a coupling section 31 having a plurality of teeth 38 in an outer periphery thereof. An engaging portion 32 extends from an end face of an end of coupling section 31 beyond head 22 via hole 27 and includes an annular groove 321 in a distal end thereof. A drive column 33 extends from the other end of coupling section 31 beyond second side 26 of head 22. Drive column 33 includes a hole receiving a ball 35. Drive member 30 further includes a central through-hole extending from engaging portion 32 through drive column 33 and in communication with the hole of drive column 33. A pushpin 36 is extended through the central through-hole and can be pushed to allow movement of ball 35 in the hole of drive column 33 for disengaging drive column 33 from a socket or the like. A spring 37 is provided to return push pin 36. Drive member 30 of other forms can be utilized according to the teachings of the present invention.

In the preferred forms shown in FIGS. 1-13, a pawl device 40 includes first and second pawls 41 and 42 slideably received in pawl groove 24. Each of first and second pawls 41, 42 includes an inner, toothed face 411, 421 releasably engaged with teeth 38 of drive member 30. First pawl 41 includes a first coupling portion 415, and second pawl 42 includes a second coupling portion 425. Specifically, each of first and second pawls 41 and 42 includes a top face 416, 426 transverse to toothed face 411, 421. A recessed portion 414, 424 is formed in top face 416, 426. First coupling portion 415 forms a side wall of recessed portion 414 of first pawl 41, and second coupling portion 425 forms a side wall of recessed portion 424 of second pawl 42. Each of first and second pawls 41 and 42 further includes a sliding face 412, 422 transverse to top face 416, 426. Each of first and second pawls 41 and 42 further includes an end face transverse to top face 416, 426 and to toothed face 411, 421 and having a peg 423. An elastic element 43 in the form shown as a spring has two ends mounted to pegs 423. Elastic element 43 biases first and second pawls 41 and 42 away from each other to engage toothed faces 411 and 421 of first and second pawls 41 and 42 with teeth 38 of drive member 30. First and second coupling portions 415 and 425 of other forms can be utilized according to the teachings of the present invention.

In the preferred forms shown in FIGS. 1-13, ratchet wrench 10 further includes a control plate 50 having first and second ends 51 and 52. Control plate 50 further includes inner and outer faces 501 and 502 extending between first and second ends 51 and 52. First end 51 of control plate 50 includes a hole 53 defining an axis coaxial to the rotating axis. Control plate 50 is rotatably mounted around a portion of engaging portion 32 of drive member 30 beyond first side 25 of head 22. A retainer ring 34 is engaged in annular groove 321 of engaging portion 32 and rests on top of control plate 50 to prevent drive member 30 and control plate 50 from disengaging from head 22 while allowing rotational movement of control plate 50. First end 51 of control plate 50 has a thickness T between inner and outer faces 501 and 502 along the rotating axis not larger than a spacing H between annular groove 321 and outer surface 251 of first side 25 of head 25 along the rotating axis.

Control plate 50 is pivotable between first, second, and third operative positions about the rotating axis of drive member 30. Second end 52 of control plate 50 includes first and second legs 54 and 55 extending from inner face 501 through slot 28 into pawl groove 24. First leg 54 extends into first recessed portion 414 and is in contact with first coupling portion 415, and second leg 55 extends into second recessed portion 424 and is in contact with second coupling portion 425, providing highly sensitive, immediate actuation of first and second pawls 41 and 42.

In the preferred form shown in FIGS. 1-10, outer surface 251 of first side 25 of head 22 includes a receptacle 29. Slot 28 is intermediate hole 27 and receptacle 29 in the length direction. Inner face 501 of control plate 50 includes first, second, and third positioning holes 56, 57, and 58 in second end 52 of control plate 50. In the preferred form shown in FIGS. 11-13, outer surface 251 of first side 25 of head 22 includes a receptacle 29A. Hole 27 is intermediate receptacle 29A and slot 29 in the length direction. Inner face 501 of control plate 50 includes first, second, and third positioning holes 56A, 57A, and 58A in first end 51 of control plate 50. First end 51 of control plate 50 has a first maximum radius R1 to the rotating axis. Second end 52 of control plate 50 has a second maximum radius R2 to the rotating axis. First maximum radius R1 is smaller than second maximum radius R2. Furthermore, receptacle 29A has a third radius R3 to the rotating axis. Third radius R3 is smaller than the first maximum radius R1. First maximum radius R1, second maximum radius R2, and third radius R3 are co-linear.

In the preferred forms shown in FIGS. 1-10, ratchet wrench 10 further includes a positioning device 60 having a positioning member 62 in the form of a ball and an elastic element 61 in the form of a spring. Positioning member 62 and elastic element 61 are received in receptacle 29. Positioning member 62 is biased by elastic element 61 into one of first, second, and third positioning holes 56, 57, and 58 to retain control plate 50 in one of the first, second, and third operative positions. In the preferred form shown in FIGS. 11-13, positioning device 60A includes a positioning member 62A and elastic element 61A received in receptacle 29A. Positioning member 62A is biased by elastic element 61A into one of first, second, and third positioning holes 56A, 57A, and 58A to retain control plate 50 in one of the first, second, and third operative positions.

Now that the basic construction of ratchet wrench 10 of the preferred teachings of the present invention has been explained, the operation and some of the advantages of ratchet wrench 10 can be set forth and appreciated. In particular, for the sake of explanation, it will be assumed that control plate 50 is initially in the third operative position (FIGS. 4, 9, and 10) intermediate the first and second operative positions. Positioning member 62, 62A is received in third positioning hole 58, 58A. Toothed portion 411, 421 of each of first and second pawls 41 and 42 is engaged with teeth 38 of drive member 30, allowing handle 21 and drive member 30 to rotate jointly in either of clockwise and counterclockwise directions to drive an object (such as a fastener or the like) in the same direction. Free rotation of handle 21 relative to drive member 30 in either direction without driving the object is not allowed. Minor adjustment in tightening/loosening of the object can be achieved easily when control plate 50 is in the third operative position.

When control plate 50 is pivoted from the third operative position to the first operative position (FIGS. 5 and 6), first leg 54 of control plate 50 engages with and moves first coupling portion 415 of first pawl 41. Thus, first pawl 41 is moved away from drive member 30. As a result, toothed portion 411 of first pawl 41 is disengaged from teeth 38 of drive member 30. Toothed portion 421 of second pawl 42 is still engaged with teeth 38 of drive member 30. Positioning member 62, 62A is received in first positioning groove 56, 56A. In this state, handle 21 and drive member 30 can rotate in the counterclockwise direction to drive the object in the counterclockwise direction. Furthermore, handle 21 can rotate freely in the clockwise direction relative to drive member 30 without driving the object.

When control plate 50 is moved from the third operative position to the second operative position (FIGS. 7 and 8), second leg 55 of control plate 50 engages with and moves second coupling portion 425 of second pawl 42. Thus, second pawl 42 is moved away from drive member 30. As a result, toothed portion 421 of second pawl 42 is disengaged from teeth 38 of drive member 30. Toothed portion 411 of first pawl 41 is still engaged with teeth 38 of drive member 30. Positioning member 62, 62A is received in second positioning hole 57, 57A. In this state, handle 21 and drive member 30 can rotate in the clockwise direction to drive the object in the clockwise direction. Furthermore, handle 21 can rotate freely in the counterclockwise direction relative to drive member 30 without driving the fastener.

Sliding face 412 of first pawl 41 or sliding face 422 of second pawl 42 slides against a peripheral wall of pawl groove 24 while control plate 50 moves between the first, second, and third operative positions. Furthermore, first and second legs 54 and 55 slide along slot 28 during movement of control plate 50 between the first, second, and third operative positions.

Inner face 501 of control plate 50 rotatably abuts outer surface 251 of first side 25 of head 22 adjacent engaging portion 32 of drive member 30. Furthermore, the end face of coupling section 31 of drive member 30 rotatably abuts inner surface 252 of first side 25 of head 22. Thus, switching between the first, second, and third operative positions of control plate 50 can be easily achieved even when drive column 33 of drive member 30 faces upward and when a socket or an extension is coupled to drive column 33. It can be appreciated that wear to control plate 50 resulting from friction between inner face 501 of control plate 50 and outer surface 251 of first side 25 of head 22 during rotation of drive member 30 will not occur, allowing smoother operation of and prolonging the service life of control plate 50. Furthermore, the direction switching operation from control plate 50 to first and second pawls 41 and 42 is direct and reliable with high sensibility while providing accurate positioning.

Figure 11:
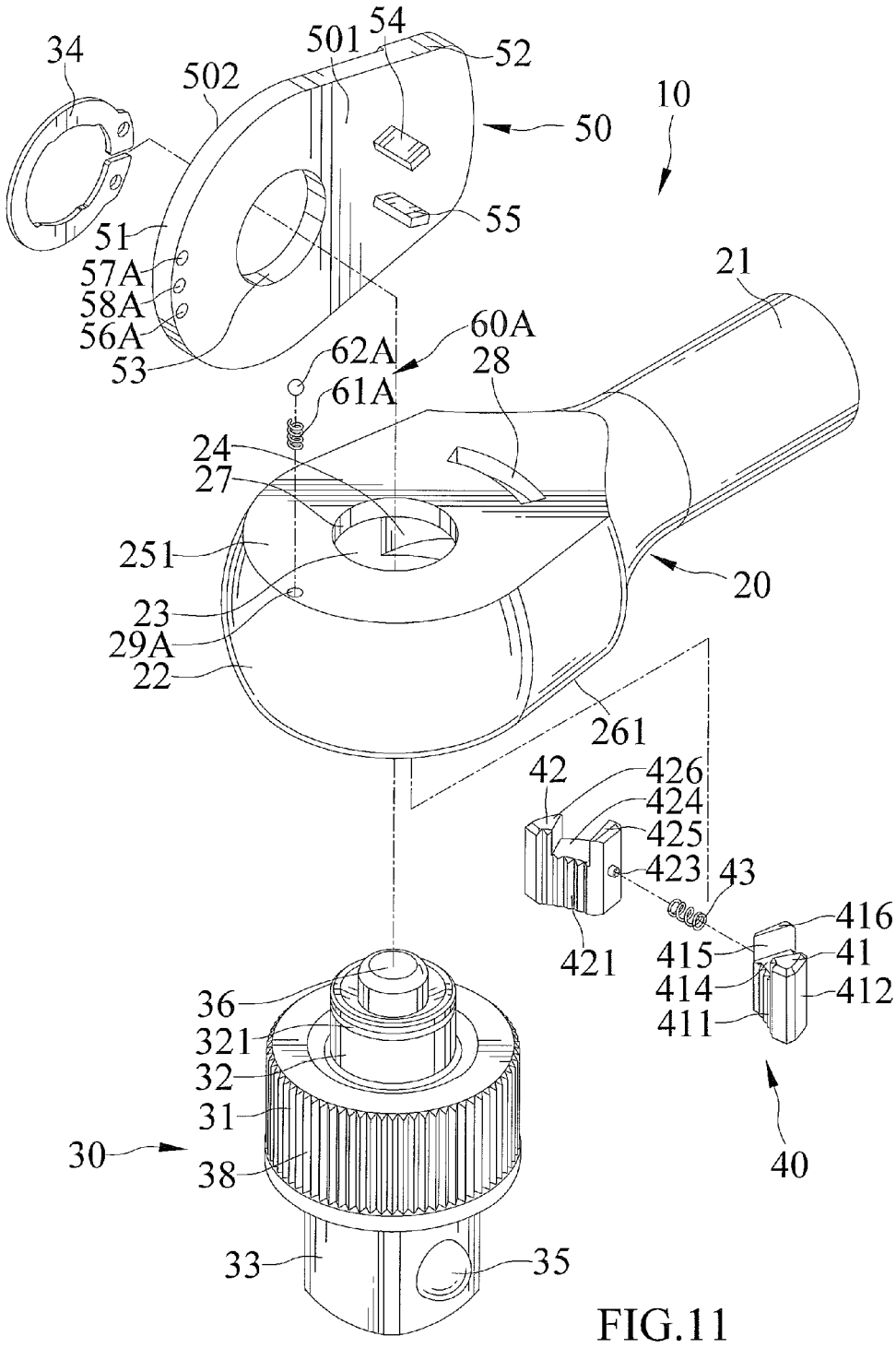
FIG. 11 shows a partial, exploded, perspective view of a ratchet wrench of a modified embodiment according to the preferred teachings of the present invention.
Figure 12:
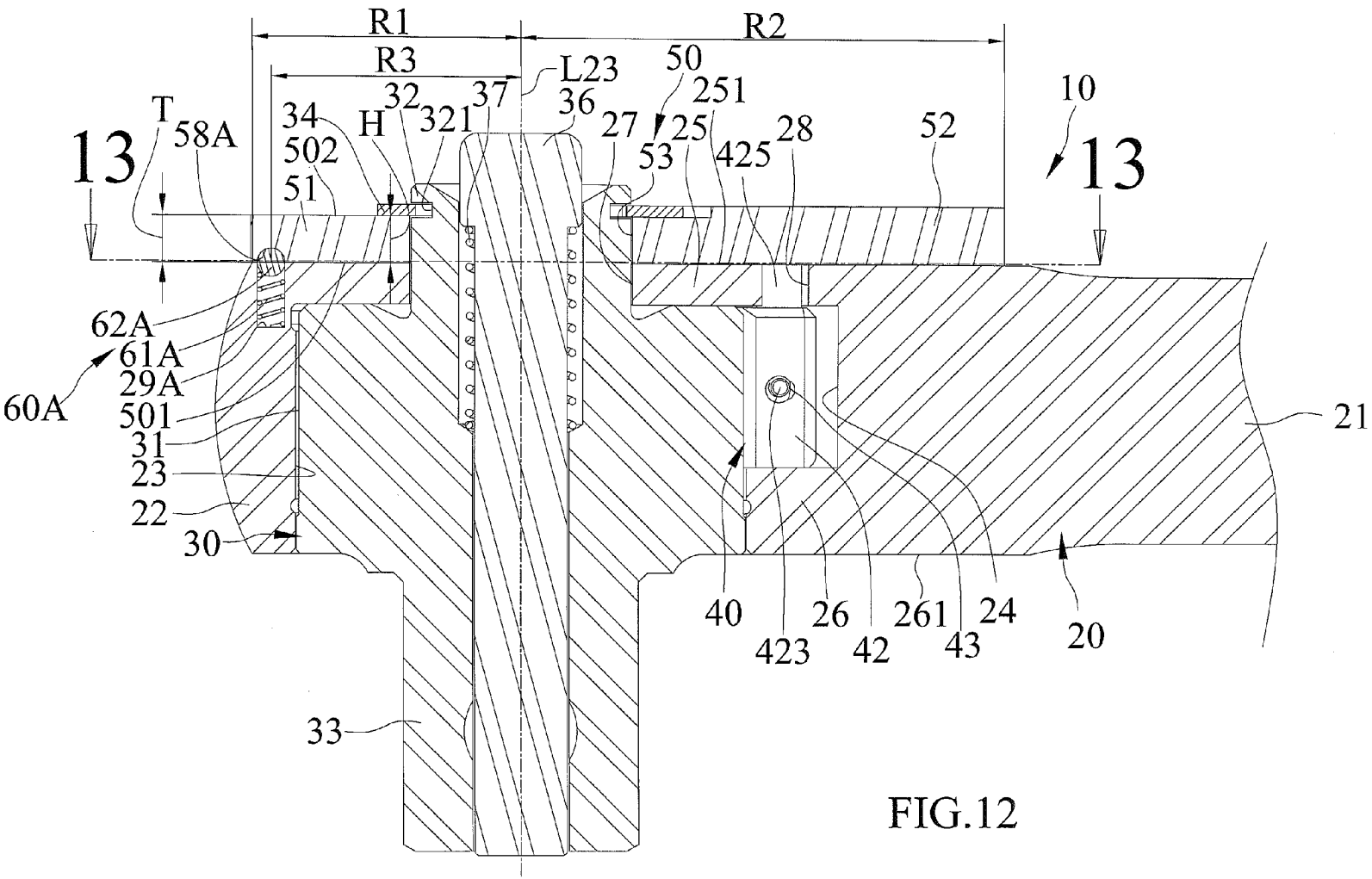
FIG. 12 shows a partial, cross sectional view of the ratchet wrench of FIG. 11.
Figure 13:
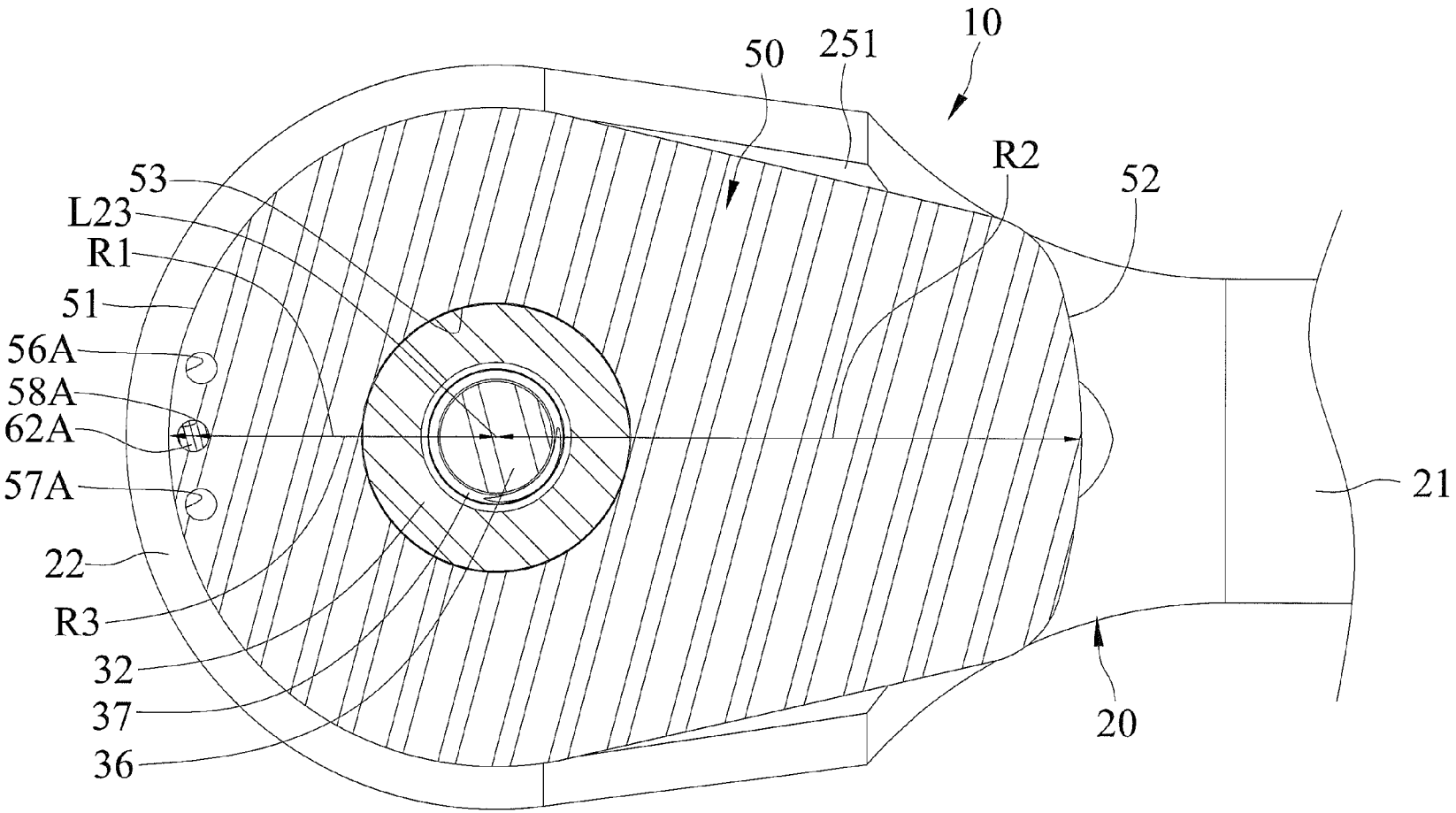
FIG. 13 shows a partial, cross sectional view of the ratchet wrench of FIG. 11 according to section line 13-13 of FIG. 12.

Furthermore, a gap between control plate 50 and head 22 is minimized in the preferred form shown in FIGS. 11-13 due to the position of receptacle 29A and/or due to co-linear arrangement of first maximum radius R1, second maximum radius R2, and third radius R3. Entrance of dust between head 22 and control plate 50 can be effectively avoided, avoiding accumulation of dust in positioning device 60, 60A and prolonging the service life of ratchet wrench 10 according to the teachings of the present invention.

Now that the basic teachings of the present invention have been explained, many extensions and variations will be obvious to one having ordinary skill in the art. For example, each of first and second pawls 31 and 32 can include a receptacle for receiving two ends of elastic element 43. Furthermore, control plate 50 can include first and second positioning holes 56 and 57, 56A and 57A, so that control plate 50 can only be retained in the first and second operative positions.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A ratchet wrench comprising, in combination:

a head and a handle interconnected to the head, with the head including first and second sides, with the head further including a compartment extending from the second side towards but spaced from the first side, with the first side including a hole in communication with the compartment, with a pawl groove defined in an inner periphery of the compartment, with the first side of the head further including a slot spaced from the hole in a length direction and in communication with the pawl groove;

a drive member rotatably received in the compartment about a rotating axis perpendicular to the length direction, with the drive member including a coupling section, with an engaging portion extending from an end of the coupling section, with the engaging portion having a portion extending beyond the head via the hole, with a drive column extending from another end of the coupling section beyond the second side of the head;

first and second pawls slideably received in the pawl groove, with each of the first and second pawls including a toothed face releasably engaged with the coupling section of the drive member, with an elastic element being mounted between the first and second pawls to bias the first and second pawls away from each other to engage the toothed faces of the first and second pawls with the coupling section of the drive member, with the first pawl further including a first coupling portion, with the second pawl further including a second coupling portion;

a control plate including first and second ends, with the control plate further including inner and outer faces extending between the first and second ends of the control plate, with the first end of the control plate pivotably mounted to the portion of the engaging portion beyond the head between first and second operative positions about the rotating axis, with the second end of the control plate including first and second legs extending from the inner face of the reversing plate through the slot of the head into the pawl groove; and a positioning device mounted between the head and the control plate for positioning the control plate in one of the first and second operative positions, wherein when the control plate is in the first operative position, the toothed face of the second pawl is engaged with the coupling section of the drive member, the first leg is engaged with the first coupling portion of the first pawl to disengage the toothed face of the first pawl from the coupling section of the drive member, allowing the handle and the drive member to rotate in a first direction driving an object in the first direction, and allowing the handle to rotate freely relative to the drive member in a second direction reverse to the first direction without driving the object, and wherein when the reversing plate is in the second operative position, the toothed face of the first pawl is engaged with the coupling section of the drive member, the second leg is engaged with the second coupling portion of the second pawl to disengage the toothed face of the second pawl from the coupling section of the drive member, allowing the handle and the drive member to rotate in the second direction driving the object in the second direction, and allowing the handle to rotate freely relative to the drive member in the first direction without driving the object.

2. The ratchet wrench as claimed in claim 1, with the first side of the head including a receptacle, with the inner face of the control plate including first and second positioning holes, with the positioning device including a positioning member and an elastic element received in the receptacle, with the elastic element biasing the positioning member into one of the first and second positioning holes to retain the control plate in one of the first and second operative positions.

3. The ratchet wrench as claimed in claim 2, with the control plate further including a third operative position intermediate the first and second operative positions, wherein when the control plate is in the third operative position, the toothed portions of the first and second pawls are engaged with the coupling section of the drive member, allowing the handle and the drive member to rotate in either of the first and second directions driving the object, and not allowing free rotation of the handle relative to the drive member in either of the first and second directions without driving the object.

4. The ratchet wrench as claimed in claim 3, with the inner face of the control plate further including a third positioning holes intermediate the first and second positioning holes, with the positioning member engaged in the third positioning hole when the control plate is in the third operative position.

5. The ratchet wrench as claimed in claim 4, with the slot intermediate the hole of the head and the receptacle in the length direction, with the first and second positioning holes formed in the second end of the control plate.

6. The ratchet wrench as claimed in claim 5, with the slot being arcuate and having a constant radius to the rotating axis.

7. The ratchet wrench as claimed in claim 5, with the hole having a diameter smaller than the compartment of the head, with the engaging portion of the drive member having a diameter smaller than the coupling section of the drive member, with each of the hole and the compartment of the head having a longitudinal axis coincident to the rotating axis, with the first side of the head including inner and outer surfaces spaced along the rotating axis, with the inner surface delimiting the compartment, with the inner face of the control plate rotatably abutting the outer surface of the first side of the head, with the engaging portion extending from an end face of the end of the coupling section of the drive member, with the end face of the coupling section rotatably abutting the inner surface of the first side of the head.

8. The ratchet wrench as claimed in claim 7, with the first pawl including a first top face transverse to the toothed face of the first pawl, with the first top face including a first recessed portion, with the first coupling portion forming a side wall of the first recessed portion, with the first leg extending into the first recessed portion, with the second pawl including a second top face transverse to the toothed face of the second pawl, with the second top face including a second recessed portion, with the second coupling portion forming a side wall of the second recessed portion, with the second leg extending into the second recessed portion.

9. The ratchet wrench as claimed in claim 2, with the hole of the head intermediate the slot and the receptacle in the length direction, and with the first and second positioning holes formed in the first end of the control plate.

10. The ratchet wrench as claimed in claim 9, with the first end of the control plate having a first maximum radius to the rotating axis, with the second end of the control plate having a second maximum radius to the rotating axis, with the first maximum radius smaller than the second maximum radius, with the receptacle having a third radius to the rotating axis, with the third radius smaller than the first maximum radius, with the first maximum radius, the second maximum radius, and the third radius being co-linear.

* * * * *